US006213082B1

(12) United States Patent
Ohori

(10) Patent No.: US 6,213,082 B1
(45) Date of Patent: Apr. 10, 2001

(54) DRIVE ARRANGEMENT FOR A TWO-CYCLE ENGINE

(76) Inventor: Hiroshi D. Ohori, 1788 Williamsport St., Henderson, NV (US) 89052

( * ) Notice: Subject to any disclaimer, the term of this patent is extended or adjusted under 35 U.S.C. 154(b) by 0 days.

(21) Appl. No.: 09/438,596

(22) Filed: Nov. 12, 1999

(51) Int. Cl.[7] ..... F02B 75/32
(52) U.S. Cl. ..... 123/197.3; 123/55.3; 123/54.3
(58) Field of Search ..... 123/54.3, 55.3, 123/48 B, 78 E, 78 F, 197.1, 197.3, 197.4, 55.5, 53.3, 55.2

(56) References Cited

U.S. PATENT DOCUMENTS 4,111,164 * 9/1978 Wuerfel ..... 123/78 E
5,287,829 * 2/1994 Rose ..... 123/90.12
5,529,029 * 6/1996 Rowe et al. ..... 123/54.3
5,634,441 * 6/1997 Ragain ..... 123/54.3

* cited by examiner

*Primary Examiner*—Willis R. Wolfe
*Assistant Examiner*—Hai Huynh
(74) *Attorney, Agent, or Firm*—Francis C. Hand; Carella, Byrne, Bain, Gilfillan, Cecchi, Stewart & Olstein

(57) ABSTRACT

The drive arrangement for the two-cycle engine employs a multi-lobe cam and piston rods which are reciprocated in a rectilinear manner. A roller is mounted on each piston rod to contact and be driven by the multi-lobe drive cam off the drive shaft of the engine. Each lobe of the drive cam is of non-symmetrical shape so that ignition is timed to take place prior to the full extension of the piston rod into an associated combustion chamber.

6 Claims, 2 Drawing Sheets

DRIVE ARRANGEMENT FOR A TWO-CYCLE ENGINE

This invention relates to a drive arrangement for a two-cycle engine.

As is known, various types of drive arrangements have been provided for driving reciprocating pistons in internal combustion engines. In some cases, the pistons have been driven off a crank shaft. In other arrangements, such as described in U.S. Pat. No. 5,669,340, a piston/cylinder arrangement employs a gear arrangement for reciprocating piston rods for the engine. In such constructions, the gear teeth of the meshing gears can be worn over time. As a result, the efficiency of the engine and the operability of the invention can diminish over time.

Accordingly, it is an object of the invention to provide a drive arrangement for a piston of a two-cycle engine which is of improved construction.

It is another object of the invention to improve the life of a drive arrangement for the piston of a two-cycle engine.

Briefly, the invention is directed to an engine having a drive shaft for rotation about a longitudinal axis thereof and at least one reciprocally mounted piston disposed radially of the shaft and is particularly directed to a drive arrangement for driving the piston off the rotation of the drive shaft.

The drive arrangement includes a multi-lobe drive cam which is mounted on the rotatable shaft for rotation with the shaft about the axis of the shaft, a piston rod which extends radially of the shaft for rectilinear reciprocation and a roller mounted on the piston road in abutment with the drive cam for reciprocating the piston rod in synchronism with the rotation of the drive cam. Still further, a spring means is provided for biasing the piston rod towards the drive shaft. The piston rod is connected to the piston at an end opposite the rotatable shaft for reciprocation of the piston in a combustion chamber.

In accordance with the invention, a drive force is transferred between the drive cam and the roller mounted on the piston rod in an efficient manner. In this respect, during operation of the engine, the piston comes under compression for only about ¼ of the cycle of the engine. Further, the pressure of compression increases only towards the end of this ¼ cycle. The multi-lobe drive cam is thus shaped so that the maximum forces which are transferred between the drive cam and roller occur only over a small portion of a lobe.

The use of the multi-lobe drive cam eliminates a need for a crankshaft and/or gears between the drive shaft and piston rod and permits reciprocation of the piston rod in a rectilinear manner.

Should wear occur in a roller which abuts against the drive cam, the roller which is removably mounted on the piston rod can be readily replaced from time to time.

These and other objects and advantages of the invention will become more apparent from the following detailed description taken in conjunction with the drawings wherein.

Figure 1:
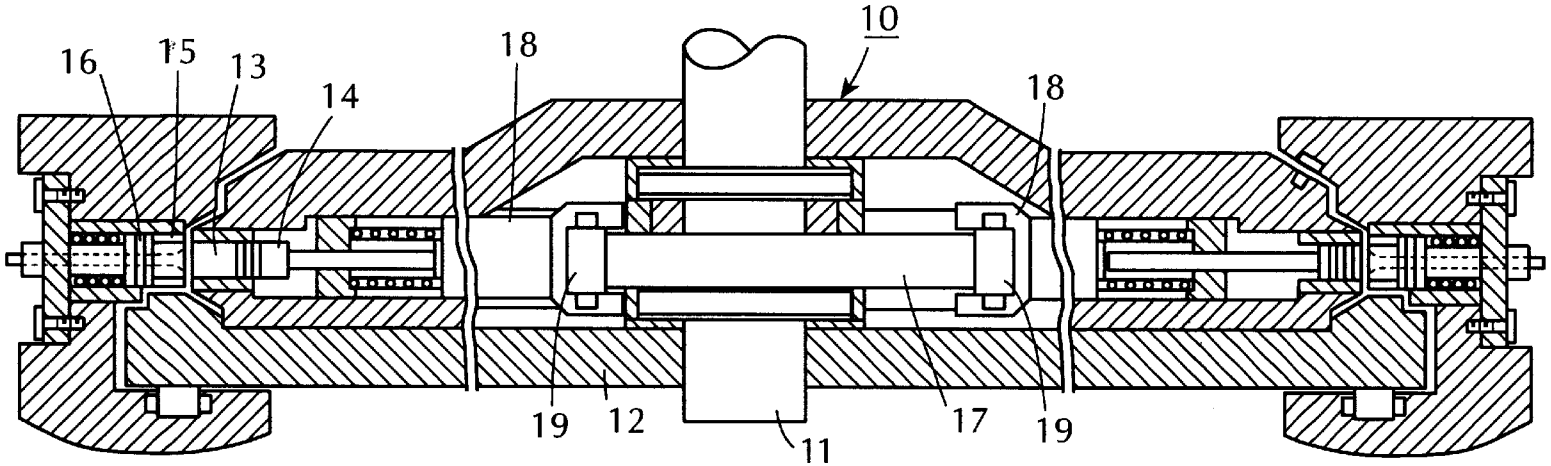
FIG. 1 illustrates a cross-sectional view of a drive arrangement constructed in accordance with the invention for a two-cycle engine.
Figure 2:
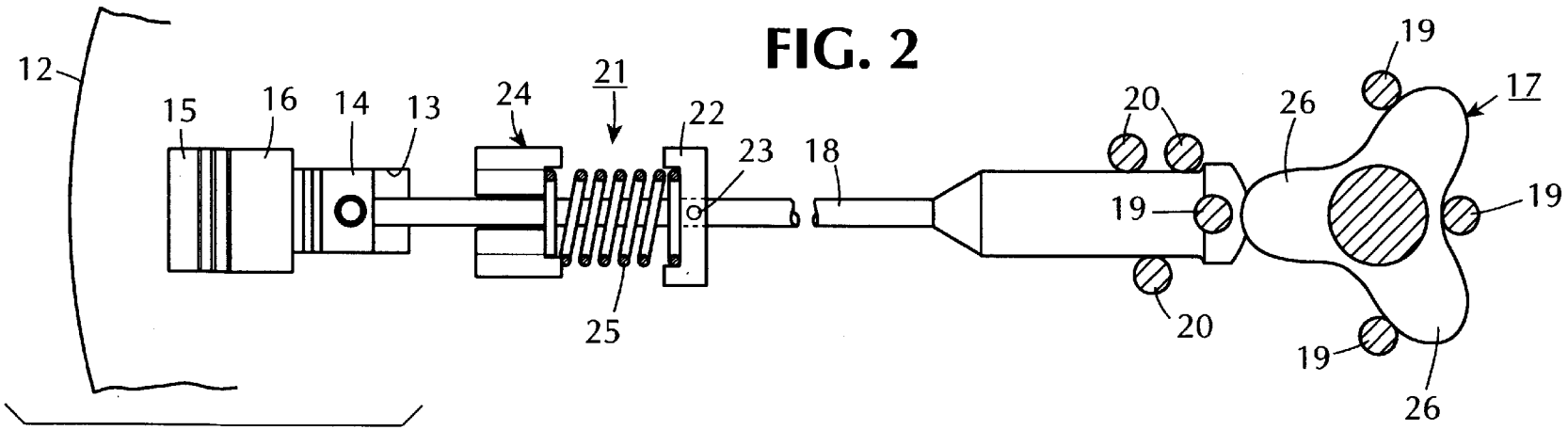
FIG. 2 illustrates a view of the drive cam-to-piston arrangement employed in the drive arrangement of FIG. 1.

Referring to FIGS. 1 and 2, the drive arrangement or transmission is mounted in a main housing 10 of an engine, such as a two-cycle engine employing a fly wheel, as described in U.S. Pat. No. 5,699,340. In this respect, the engine includes a drive shaft 11 for rotation about a longitudinal axis thereof, a rotatably mounted fly wheel 12 which rotates about the axis of the drive shaft 11, a plurality of combustion chambers 13 (only one of which is shown in FIG. 2) disposed peripherally in the main housing 10 about the axis of the drive shaft 11, and a plurality of compression pistons 14 (only one of which is shown). Each piston 14 is slidably mounted in a respective combustion chamber 13. The engine also has a second plurality of chambers 15 disposed peripherally in a secondary housing 10' about the axis of the drive shaft 11 with each second chamber 15 disposed opposite a combustion chamber 13. A counter-piston 16 is slidably mounted in each second chamber 15.

The drive arrangement 10 replaces the gear-based transmission and unguided piston rods of the engine described in U.S. Pat. No. 5,699,340 and includes a multi-lobe drive cam 17 which is mounted on the shaft 11 for rotation about the axis of the drive shaft 11 and a plurality of reciprocally mounted piston rods 18 which extend radially of the shaft 11. In addition, a roller 19 is mounted on each piston rod 18 and is disposed in abutment with the drive cam 17 for reciprocating the piston rod 18 in synchronism with rotation of the drive cam 17.

Referring to FIG. 2, each piston rod 18 is connected in suitable fashion to the piston 14 at the end opposite from the drive shaft 11 and serves to reciprocate the piston 14 within the combustion chamber 12. A plurality of rollers 20 mounted in the housing 10 for guiding the piston rod 14 in a rectilinear manner relative to the drive shaft 11.

The drive arrangement also includes a spring means 21 for each piston rod 18 for biasing the piston rod 18 towards the drive shaft 11.

As shown in FIG. 2, the spring means 21 includes an annular cup-shaped washer 22 secured to and about the piston rod 18 via a pin 23, a shaft guide 24 which is fixedly mounted in the housing 10 (FIG. 1) of the engine in a manner not shown and a coiled spring 25 which is disposed between the washer 22 and the shaft guide 24. As indicated, the shaft guide 24 is disposed concentrically of the piston rod 18 and the coiled spring 25 is disposed about the piston rod 18.

Referring to FIG. 2, the drive cam 17 has three radially disposed lobes 26 disposed in equi-spaced manner about the circumference of the drive cam 17. The drive cam 17 abuts against the roller 19 mounted on each piston rod 18 at all times so that continuous contact is maintained between the cam 17 and each roller 19. As schematically illustrated by four rollers 19, the engine is provided with four combustion chambers 13 and the drive arrangement has four reciprocally mounted piston rods 18 for driving the pistons 14 of the each respective chamber 13.

Figure 3:
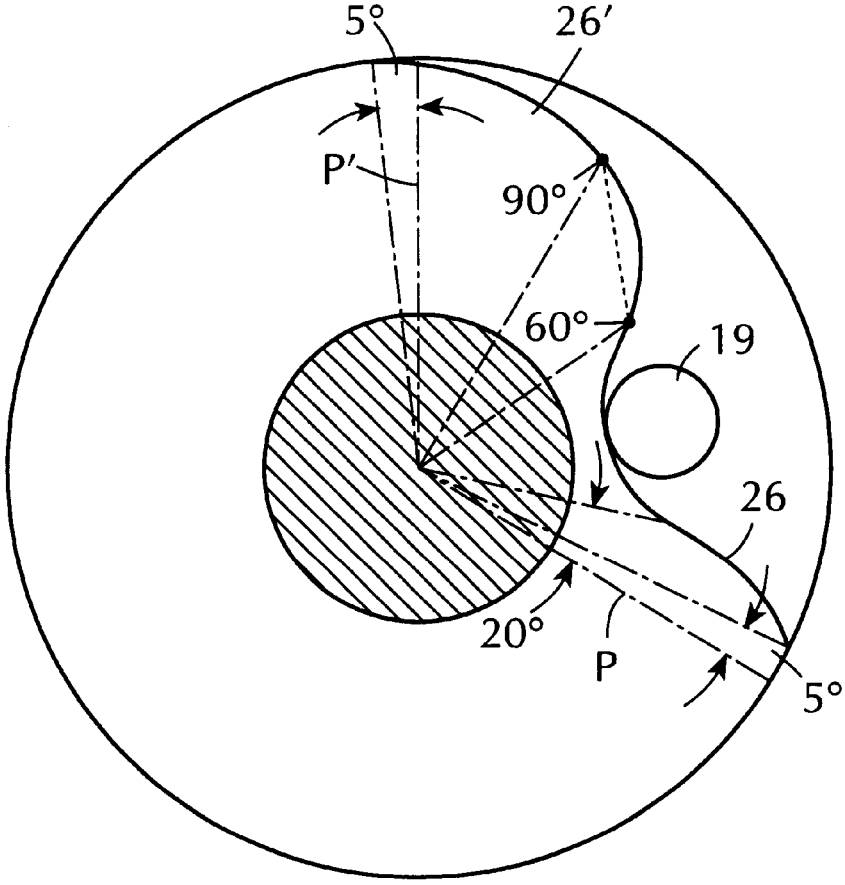
FIG. 3 illustrates as enlarged developed view of a lobe of the drive cam.

Referring to FIG. 3, the surface of the drive cam 17 is configured so that each lobe 26 is of non-symmetrical shape about a central plane P so as to avoid jamming of the drive cam 17. Thus, before the lobe 26 of the drive cam 17 moves a piston rod 18 to the outermost position, ignition of the fuel in the gap between the compression piston 14 and the opposed counter-piston 16 takes place. After ignition, the compression piston 14 continues to move radially outwardly from the drive cam 17 via the lobe 26. At the same time, the counter piston 16 moves in a direction away from the compression piston 16. During this time, the gap between the two piston closes and thereafter, the compression piston 14 is retracted so as to move away from the counter piston 16.

For example, with the drive cam 17 rotating in a clockwise direction as indicated in FIG. 3, the apex, or a high point, of a lobe 26 begins 5° beyond a radial reference plane P which corresponds to the ignition point in the associated combustion chamber 13. The trailing side of the lobe 26 then continues radially inwardly in a curved manner to a circular arc which extends from a 20° position to a 60° position relative to the reference plane P. During this time, the piston rod 18 (not shown) is retracting. The circular arc merges into the leading end of the next lobe 26' which has a curved surface extending radially outwardly beyond the reference plane P of the lobe to a position 5° beyond a second reference plane P' spaced 120° from the first reference plane P. During this time, the piston rod 18 (not shown) is again moved towards the counter piston 16.

As indicated in FIG. 3, a portion of the leading end of a lobe 26 may be flattened, as indicated by the dotted line, in order to change the speed of the compression stroke of the piston rod 18 and thus the compression piston 14.

Figure 4:
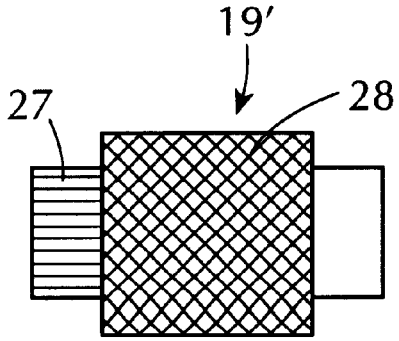
FIG. 4 illustrates a roller of modified construction for engaging the drive cam.

As indicated in FIG. 1, each roller 19 is rotatably mounted in a yoke-like end of a piston rod 18. Alternatively, as shown in FIG. 4, each roller 19' may have a serrated base 27 for removable mounting of the roller 19 in a mating recess of the piston rod 18 and a member 28 which is rotatably mounted on the base 27 and which has a textured surface for abutting the drive cam 17. The textured peripheral surface may be provided with a wear-resistant coating or the like to enhance the useful life of the roller 19. Further, the mounting of the base 27 in the piston rod 18 is such that the roller 19 may be removed from time to time for replacement purposes should the need arise.

The drive arrangement 10 is such that each piston rod 18 is able to reciprocate in a rectilinear manner radially of the axis of the drive shaft 11. Thus, the driving force of the piston rod 18 on a piston 14 can be transferred in an efficient manner. Likewise, transfer of a driving force from the drive cam 17 to a piston rod 18 is effected in a rectilinear manner as the contact point between the drive cam 17 and the roller 19 on a piston rod 18 is maintained in a plane passing through the longitudinal axis of the drive shaft 11 and the longitudinal axis of the piston rod 18.

Since the contact points between the drive cam 17 and the roller 19 are located on movable surfaces, i.e. on the rotatable cam 17 and the rotatable roller 19, sliding friction is avoided between the drive cam 17 and roller 19 thereby increasing the useful life of each.

Since the drive forces transmitted by the piston rod 18 are transferred coaxially, the piston rod 18 may have a slender construction between the enlarged base of the piston rod and the piston 14. In this respect, only compression forces are transferred through the piston rod 18. By way of example, the distance between the contact point of the roller 19 with the drive cam 17 and the end of the combustion chamber 13 in which the piston 14 reciprocates is of a length of 1'10". Thus, the piston rod 18 is of relatively long length as compared with the piston rods of a conventional internal combustion engine. However, as only coaxial compression forces are being transferred by the piston rod 18, the extended length of the piston rod 18 is of no particular consequence from a structural point of view. Thus, the fly wheel 12 may be made of any particular diameter without introducing any skewing forces on the piston rods 18 of the driving arrangement.

The invention thus provides a drive arrangement which operates on a continuous basis so as to reduce wear and tear and provide a longer life to the engine.

The invention further provides a transmission which operates with reduced wear and longer life than a transmission employing gears as described in U.S. Pat. No. 5,669,340. Further, rather than having a rocking like motion as in the engine described in U.S. Pat. No. 5,669,340, the piston rods reciprocate in a simple reciprocating manner and can be guided with limited wear. Thus, the length of the piston rod may be extended so as to increase the lever arm for a flywheel of greater diameter. Thus, the momentum provided by the larger diameter flywheel may be readily increased.

What is claimed is:

1. An engine comprising a drive shaft for rotation about a longitudinal axis thereof;

a multi-lobe drive cam secured to said drive shaft for rotation therewith;

at least one reciprocally mounted piston rod extending radially of said shaft;

a roller mounted on said piston rod and disposed in abutment with said drive cam for reciprocating said piston rod in synchronism with rotation of said drive cam;

spring means biasing said piston rod toward said drive shaft;

a piston mounted on said piston rod at an end opposite said shaft for reciprocation in a combustion cylinder;

a second chamber opposite said piston; and a counter-piston slidably mounted in said second chamber in opposition to said piston.

2. An engine as set forth in claim 1 which further comprises a plurality of rollers for guiding said piston rod in rectilinear manner.

3. An engine as set forth in claim 1 wherein said drive cam has three radially disposed lobes thereon and wherein four of said piston rods are disposed symmetrically about said drive shaft.

4. An engine as set forth in claim 1 wherein said spring means includes an annular cup-shaped washer secured to and about said piston rod, a shaft guide disposed in fixed relation concentrically of said piston rod and a coiled spring disposed about said piston rod between said washer and said shaft guide.

5. A drive arrangement for a piston of an engine, said arrangement comprising a multi-lobe drive cam for mounting on a rotatable shaft for rotation about a first axis;

a least one reciprocally mounted piston rod extending radially from said axis; a roller mounted on said piston rod and disposed in abutment with said drive cam for reciprocating said piston rod in synchronism with rotation of said drive cam; and spring means biasing said piston rod towards said axis, said spring means including an annular cup-shaped washer secured to and about said piston rod, a shaft guide disposed in fixed relation concentrically of said piston rod and a coiled spring disposed about said piston rod between said washer and said shaft guide.

6. A drive arrangement as set forth in claim 5 wherein said drive cam has three radially disposed lobes thereon and wherein four of said piston rods are disposed symmetrically about said drive shaft.

* * * * *